United States Patent [19]

Fikentscher et al.

[11] Patent Number: 4,488,879

[45] Date of Patent: Dec. 18, 1984

[54] PROCESS FOR DYEING TEXTILE MATERIALS OF POLYACRYLONITRILE: QUATERNIZED PIPERAZINE COPOLYMER AS BASIC DYE RETARDER

[75] Inventors: Rolf Fikentscher, Ludwigshafen; Herbert Fleischer, Beindersheim; Sigismund Heimann, Ludwigshafen; Heinrich Mertens, Frankenthal, all of Fed. Rep. of Germany

[73] Assignee: BASF Aktiengesellschaft, Ludwigshafen, Fed. Rep. of Germany

[21] Appl. No.: 510,564

[22] Filed: Jul. 5, 1983

[30] Foreign Application Priority Data

Jul. 10, 1982 [DE] Fed. Rep. of Germany ..... 3225877

[51] Int. Cl.[3] ..... D06R 3/00

[52] U.S. Cl. ..... 8/539; 8/554; 8/567; 8/606; 8/654; 8/657; 8/927

[58] Field of Search ..... 8/539, 554, 567, 606

[56] References Cited

U.S. PATENT DOCUMENTS

| | | | |
|---|---|---|---|
| 3,917,817 | 11/1975 | Vanlerberghe et al. | 424/70 |
| 4,052,159 | 10/1977 | Fuerst et al. | 8/539 |
| 4,220,449 | 9/1980 | Baumann | 8/606 |

*Primary Examiner*—A. Lionel Clingman

*Attorney, Agent, or Firm*—Bernhard R. Swick

[57] ABSTRACT

This invention relates to dyeing textile materials of polyacrylonitrile or copolymers containing acrylonitrile in polymerized form with basic dyestuffs in aqueous dyeing liquors using the exhaust method employing retarders. The retarders are obtained by condensing (a) piperazine and piperazine derivatives with (b) ethylene chloride, epihalohydrin, propylene chloride, 1,3-dichloro-2-hydroxypropane, bis-epoxybutane, 1,4-dichlorobutene or their mixtures in mole ratios of 1:0.9 to 1:1.1. The condensation products are then quaternized with benzyl chloride using 0.8 to 1.5 moles of benzyl chloride per mole of component (a) for the quaternization. The aqueous solutions of the retarders either do not foam or show a very low foaming tendency.

11 Claims, No Drawings

PROCESS FOR DYEING TEXTILE MATERIALS OF POLYACRYLONITRILE: QUATERNIZED PIPERAZINE COPOLYMER AS BASIC DYE RETARDER

BACKGROUND OF THE INVENTION

1. Field of the Invention

The present invention relates to dyeing textile materials of polyacrylonitrile or copolymers containing acrylonitrile using basic dyes in aqueous liquors.

2. Prior Art

It is known that an unevenly dyed product results when basic dyes are used in a concentrated dyeing liquor for polymer fibers containing anionic polyacrylonitrile or acrylonitrile containing copolymer fibers as soon as there are even slight temperature and concentration differences in the dyeing equipment. The penetration rate of cationic dyes used for anionically modified polyacrylonitrile fibers is particularly dependent upon temperature. In order to be able to uniformly dye polyacrylonitrile fibers with cationic dyes, retarders are used. These are compounds which reduce the penetration rates of the dyes in the penetration phase. Quaternary ammonium salts of 1,3,5-trisaminoalkylhexahydro-s-triazines according to German Pat. No. 23 16 725 and quaternized polyamines described in German application No. 25 0/8 242 are known as suitable examples for this purpose. However, when used with the most commonly applied cationic dyes for dyeing polyacrylonitrile fibers, the known retarders do not show uniform retardation effects in the temperature range in which the dyeing processes are carried out.

It is a purpose of this invention to make available retarders for dyeing textile materials of polyacrylonitrile or copolymers containing acrylonitrile in polymerized form using basic dyes in aqueous liquors and employing the exhaust method. These retarders must be compatible with the most commonly used cationic dyes, must have a uniform retardation effect, if possible, in the entire temperature range used for the dyeing process and must not develop any foam or inhibit the development of foams in aqueous liquors.

SUMMARY OF THE INVENTION

The above requirements are met by this invention by the use of water-soluble reaction products as retarders which are obtained by the condensation of (a) piperazine, bis-(1,4-aminopropyl)piperazine, 1-aminoethylpiperazine, 1-methylpiperazine or their mixtures with (b) ethylene chloride, epihalohydrin, propylene chloride, 1,3-dichloro-2-hydroxy propane, bisepoxybutane, 1,4-dichlorobutane or their mixtures in a mole ratio of (a):(b) of 1:0.9 to 1:1.1 and quaternization of the condensation products with benzylchloride. The amount of benzylchloride used for the quarternization is about 0.8 to 1.5 moles per mole of component (a).

DESCRIPTION OF THE PREFERRED EMBODIMENTS

The textile materials may be woven or knitted fabric, yarn or flock. They consist of polyacrylonitrile and/or copolymers containing acrylonitrile in polymerized form. The acrylonitrile share of the copolymers is at least 50 percent by weight, preferably 80 to 98 percent by weight. The copolymers of acrylonitrile may, for example, contain acrylamide, acrylate, methacrylate, vinyl ester or vinyl chloride in polymerized form as comonomers. In order to improve the tintability of the polyacrylonitrile fibers, the copolymers usually contain anionic groups such as carboxyl or sulfonic acid groups. An anionic modification of the polyacrylonitrile and/or the copolymers of acrylonitrile is obtained by also using ethylenically unsaturated carboxylic acids such as acrylic acid, methacrylic acid, or maleic acid and/or ethylenically unsaturated sulfonic acids such as vinyl sulfonic acids during the copolymerization. A sufficient tintability of the fibers is also facilitated by part of the nitrile groups of the polyacrylonitrile being hydrolyzed into carboxyl groups.

Basic dyes include, for example, dyes of the di- and triarylmethane series, the indolyl- and diindolylaryl methane series, oxazine, thiazine, diazine, thiazol, xanthene, acridine, quinoline, quinophthalone, indolin and cyanine dyes as well as the basic azo and azomethine dyes. Dyes of this type are described, for example, in *American Dyestuff Reporter*, (1954), pages 432–433.

The textile materials based on polyacrylonitrile are dyed in an aqueous liquor according to the exhaust method using temperatures from 70° C. to 110° C. The liquor ratio is 1:5 to 1:100.

In order to achieve uniform wet and lightfast dyeing results, water-soluble polymeric reaction products of the above-described type are used are retarders. They are prepared by condensing (a) compounds selected from the group consisting of piperazine, bis(1,4-aminopropyl)piperazine, 1-aminoethylpiperazine, 1-methylpiperazine with (b) compounds selected from the group consisting of ethylene chloride, epihalohydrin (for example, epichlorohydrin and epibromohydrin), propylene chloride such as propylene dichloride and 1,3-propylene chloride, 1,3-dichloro-2-hydroxypropane, bisepoxybutane or 1,4-dichlorobutane in a mole ratio of about 1:0.9 to 1:1.1 with pH values from about 6.5 to 12, preferably about 7 to 10, and subsequent quaternization of the condensation products with benzylchloride. For adjusting the pH value during the condensation, optionally used products include bases such as sodium hydroxide solution, potassium hydroxide solution, sodium carbonate, calcium oxide, calcium hydroxide, barium oxide or barium hydroxide. If an excess of the compounds of group (a) are used for the condensation, a pH value in the alkaline range will result based on the bascisity of these compounds.

The condensation takes place in aqueous solution with a solids content in the solution of 20 to 60 weight percent and temperatures of 60° C. to 100° C. The water-soluble, nonquaternized condensation products have a viscosity of at least 3000 mPas in 45 percent aqueous solution at a temperature of 20° C. Particularly effective retarders are obtained if piperazine is condensed with epichlorohydrin or ethylene oxide and if the resultant product is subsequently quaternized with benzylchloride.

In order to quaternize the condensation products of components (a) and (b), 0.8 to 1.5, preferably 0.9 to 1.3, moles of benzylchloride are used per mole of component (a). The quaternization is preferably carried out in an aqueous medium at temperatures from 60° C. to 100° C. The condensation reaction as well a the quaternization of the condensation products may be carried out at temperatures above 100° C. under pressure. This results in shorter reaction times. The aqueous solutions of the quaternized condensation products can be used directly as retarders.

Compared with known retarders for dyeing textile materials of copolymers containing polyacrylonitrile or acrylonitrile, the compounds to be used in accordance with this invention have the advantage that they are more effective and that significantly lower quantities are required in order to obtain the same uniformity achieved with previously used retarders. Another advantage lies in the fact that the quaternized condensation products to be used in accordance with this invention do not tend to fiber blocking even with high application concentrations. This means that the dye subsequently used for shading the material penetrates within the normal dyeing period. This is not the case, for example, as far as the prior art retarder lauryl-dimethylbenzyl ammonium chloride is concerned even if relatively small quantities are used. A particular advantage in the use of quaternized condensation products of components (a) and (b) in accordance with this invention must be seen in the fact that the aqueous liquors either do not foam at all or foam only very slightly. The dyeing liquors contain the retarder in an amount of 0.003 to 2, preferably 0.02 to 0.5 weight percent.

As used herein, unless otherwise indicated, all parts and percentages are by weight and all temperatures are in ° C.

PREPARATION OF THE RETARDERS

Retarder 1

An amount of 47.7 parts of distilled water were added to 95.5 parts by weight of a 67.2 percent aqueous piperazine solution and this solution was heated to a temperature of 75° C. As soon as this temperature was reached, 69 parts of epichlorohydrin were added within a period of one hour and a temperature range of 70° C. to 80° C. and the mixture was subsequently heated for three hours at a temperature of 80° C. During this period, the viscosity of the reaction mixture increased to approximately 5000 mPas whereas the pH value dropped to 7.0. Following this process, 134.3 parts of water and 59.7 parts of a 50 percent sodium hydroxide solution were added followed by 95 parts of benzylchloride at a temperature of 80° C. within a period of 40 to 60 minutes. The benzylation was completed by heating the mixtures for two hours at a temperature of 80° C. The reaction mixture was cooled to 30° C. and 343.1 parts of an 85 percent formic acid and 156.7 parts of water were added. A total of 1000 parts of retarder 1 were obtained.

Retarder 2

Three hundred forty-six parts (3.5 moles) of ethylene chloride were added to 717 parts (3.7 moles) of piperazine hexahydrate and 200 parts of water at a temperature in the range of 70° to 80° C. within a period of 3 to 4 hours. After completing the ethylene chloride addition, the reaction mixture was heated to boiling under reflux within a period of two hours. Following this process, 812 parts of a 50 percent aqueous potassium hydroxide solution and 2500 parts of water (pH 11.3) were added, and the mixture heated to a temperature of 80° C. to 90° C. for three hours. The resulting suspension was diluted with water. The finely crystalline polyethylene piperazine was subsequently removed by centrifuging and dried.

At a temperature of 70° C. to 80° C., 63.5 parts of benzyl chloride were added to a suspension of 56 parts of the polyethylene piperazine in 80 parts of water within a period of ten minutes. The reaction mixture was then heated to a temperature of 80° C. for two hours. The mixture was subsequently cooled to 25° C. and was diluted with 40 parts of water. A 50 percent aqueous solution of retarder 2 was obtained.

EXAMPLE 1

One hundred parts of a commercially available anionically modified polyacrylonitrile highly texturized yarn were dyed in 6000 parts of a dyeing liquor which contained 0.2 part of the cationic dye having formula

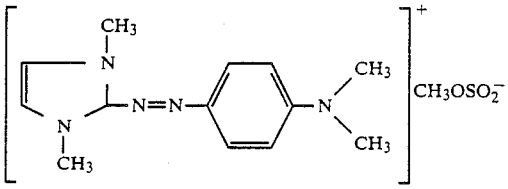

1 part of glacial acetic acid, 0.5 part sodium acetate and 0.02 part of retarder 1 based on the yarn.

The temperature of the dyeing bath initially was 85° C. and was increased to 100° C. within a period of six minutes. Following this process, the yarn was dyed at 100° C. for 30 minutes. The amount of retarder was selected in such a manner that approximately 98 percent of the dye had penetrated the polyacrylonitrile fiber after this period. A uniform, light and wetfast red coloration was obtained.

EXAMPLE 2

One hundred parts of a yarn of an anionically modified polyacrylonitrile were dyed in 5000 parts of a dyeing liquor which contains 0.5 part sodium acetate, 2 parts acetic acid, 0.1 part retarder 2 and 0.1 part of the dye having formula

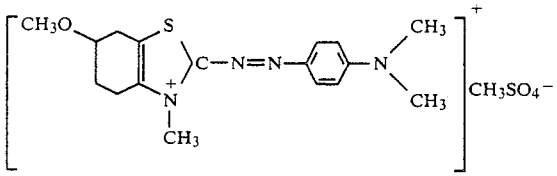

After heating the dyeing liquor to a temperature of 75° C., the fiber material was introduced into the liquor which was heated to 100° C. within 50 minutes and the material was dyed at this temperature for 40 minutes. A uniform light and wetfast blue coloration was obtained.

EXAMPLE 3

One hundred parts of a mixed yarn consisting of 55 percent polyacrylonitrile fibers (anionically modified) and 45 percent wool were introduced in 4000 parts of a dyeing liquor which was heated to 40° C. and was subsequently adjusted to a pH of 4.5 with acetic acid. An amount of 0.51 parts of the red acid dye C.I. 17070 and 0.2 parts of an oleylamine condensed with 12 moles of ethylene oxide were added and the dyeing liquor was heated from 40° C. to 80° C. within 60 minutes. At this temperature the following substances were added: 0.1 part of the yellow basic dye C.I. 48055, 0.01 part of the green basic dye C.I. 4200, 0.1 part of the red basic dye, C.I. 48013, and 0.02 part of retarder 1.

The temperature of the dyeing bath was increased to 100° C. within 40 minutes. Subsequently the dyeing process was continued at this temperature for 30 minutes. A uniform red coloration with good fastness was obtained.

EXAMPLE 4

One hundred parts of a mixed yarn consisting of 45 percent polyacrylonitrile fibers (anionically modified) and 45 percent wool were introduced into 4000 parts of a dyeing liquor which was heated to 40° C. and was subsequently adjusted to a pH of 4.5 with acetic acid.

Subsequently 0.5 part of the green acid dye C.I. 61570 and 0.2 part of a reaction product of $C_{18}$-fatty alcohol with 30 moles of ethylene oxide were added. The dyeing liquor was then heated from 40° C. to 80° C. within a period of 60 minutes.

At this temperature, 0.32 part of the green basic dye C.I. 42,000; 0.06 parts of the yellow basic dye C.I. 48,054; 0.01 part of the red basic dye C.I. 48,013 and 0.2 part of retarder 2 were added.

The temperature of the dyeing bath was increased to 100° C. for 40 minutes. The fabric was then dyed at this temperature for another 30 mintues. A uniform, wetfast green coloration was obtained.

The embodiments of this invention in which an exclusive property or privilege is claimed are defined as follows:

1. In a process for dyeing textiles of anionic polyacrylonitrile or copolymers containing acrylonitrile in polymerized form with basic dyestuffs in aqueous baths according to the exhaust method, employing retarders the improvement wherein said retarders are water soluble reaction products prepared by (1) condensation of (a) compounds selected from the group consisting of piperazine, bis-(1,4-aminopropyl)-piperazine, 1-aminoethylpiperazine, 1-methylpiperazine and mixtures thereof with (b) compounds selected from the group consisting of ethylene chloride, epihalohydrin, propylene chloride, 1,3-dichloro-2-hydroxypropane, bis-epoxybutane, 1,4-dichlorobutane, and mixtures thereof the mole ratio of (a):(b) being about 1:09 to 1:1.1 and (2) quaternization of the condensation products with benzylchloride (a) the amount of benzylchloride being about 0.8 to 1.5 moles per mole of component (a).

2. The process of claim 1 wherein said condensation step (1) and said quaternization step (2) are carried out at a temperature of at least about 60° C.

3. The process of claim 2 wherein said retarders are prepared by condensation of (a) piperazine with (b) eipchlorohydrin or ethylene chloride.

4. The process of claim 2 wherein said condensation is carried out in an aqueous solution containing 20 to 60 percent by weight solids.

5. The process of claim 2 wherein said condensation step and said quaternization step are carried out at a temperature of about 60° C. to 100° C.

6. The process of claim 5 wherein said aqueous dyestuff bath contains about 0.003 to 2.0 percent by weight of said retarder.

7. In an aqueous composition for dyeing textiles of anionic polyacrylonitrile or copolymers containing acrylonitrile in polymerized form with basic dyestuffs according to the exhaust method, employing retarders the improvement wherein said retarders are water soluble reaction products prepared by (1) condensation of (a) compounds selected from the group consisting of piperazine, bis-(1,4-aminopropyl)-piperazine, 1-aminoethylpiperazine, 1-methylpiperazine and mixtures thereof with (b) compounds selected from the group consisting of ethylene chloride, epihalohydrin, propylene chloride, 1,3-dichloro-2-hydroxypropane, bis-epoxybutane, 1,4-dichlorobutane, and mixtures thereof the mole ratio of (a):(b) being about 1:09 to 1:1.1 and (2) quaternization of the condensation products with benzylchloride (a) the amount of benzylchloride being about 0.8 to 1.5 moles per mole of component (a).

8. The composition of claim 7 wherein said retarders are prepared by condensation of (a) piperazine with (b) eipchlorohydrin or ethylene chloride.

9. The composition of claim 8 wherein the amount of said retarder is about 0.003 to 2.0 percent by weight.

10. A retarder for aqueous baths for dyeing textiles of anionic polyacrylonitrile or copolymers containing acrylonitrile in polymerized form with basic dyestuffs wherein said retarder is prepared by (1) condensation of (a) compounds selected from the group consisting of piperazine, bis-(1,4-aminopropyl)-piperazine, 1-aminoethylpiperazine, 1-methylpiperazine and mixtures thereof with (b) compounds selected from the group consisting of ethylene chloride, epihalohydrin, propylene chloride, 1,3-dichloro-2-hydroxypropane, bis-epoxybutane, 1,4-dichlorobutane, and mixtures thereof the mole ratio of (a):(b) being about 1:09 to 1:1.1 and (2) quaternization of the condensation products with benzylchloride (a) the amount of benzylchloride being about 0.8 to 1.5 moles per mole of component (a).

11. The retarder of claim 10 wherein said compound (a) is piperazine and said compound (b) is eipchlorohydrin or ethylene chloride.

* * * * *